United States Patent [19]

Kozuka et al.

[11] 4,422,261

[45] Dec. 27, 1983

[54] TOY CAPABLE OF PIVOTAL MOVEMENT ON A SUPPORT SURFACE

[75] Inventors: Michihiro Kozuka; Masayuki Tonokura, both of Tokyo, Japan

[73] Assignee: Tomy Kogyo Co., Inc., Tokyo, Japan

[21] Appl. No.: 393,883

[22] Filed: Jun. 30, 1982

[51] Int. Cl.[3] ..... A63H 11/10

[52] U.S. Cl. ..... 46/104; 46/119

[58] Field of Search ..... 46/103–107, 46/110, 97, 98, 99, 211, 119, 149, 266, 150, 264, 265, 120

[56] References Cited

U.S. PATENT DOCUMENTS

| | | | |
|---|---|---|---|
| 2,248,214 | 7/1941 | Bleeker | 46/107 |
| 2,566,141 | 8/1951 | Poli | 46/107 |
| 2,896,371 | 7/1959 | Ardolino | 46/110 X |
| 3,648,408 | 3/1972 | Terzian et al. | 46/104 X |
| 3,721,040 | 3/1973 | Goldfarb | 46/119 |

*Primary Examiner*—Mickey Yu

*Attorney, Agent, or Firm*—K. H. Boswell; Edward D. O'Brien

[57] ABSTRACT

A toy capable of pivotal movement on a support surface has an articulated body divided into a lower and upper section. A motor is located in the body and drives a set of drive wheels to propel the toy across a support surface. A member is associated with the motor and is capable of pivoting the upper body section side to side with respect to the lower body section. The upper body section includes a left side extension and a right side extension. Both of these extensions extend downwardly from the upper body section toward the support surface and are capable of either contacting the support surface or being lifted upwardly from the support surface in response to the side to side movement of the upper body section with respect to the lower body section. The toy will pivot to the left during motion when the left side extension contacts the support surface and the toy will pivot to the right when the right side extension contacts the support surface as the toy is propelled on the support surface.

10 Claims, 6 Drawing Figures

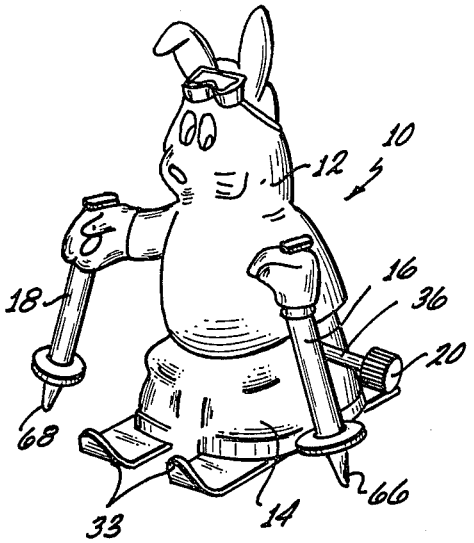
FIG. 1
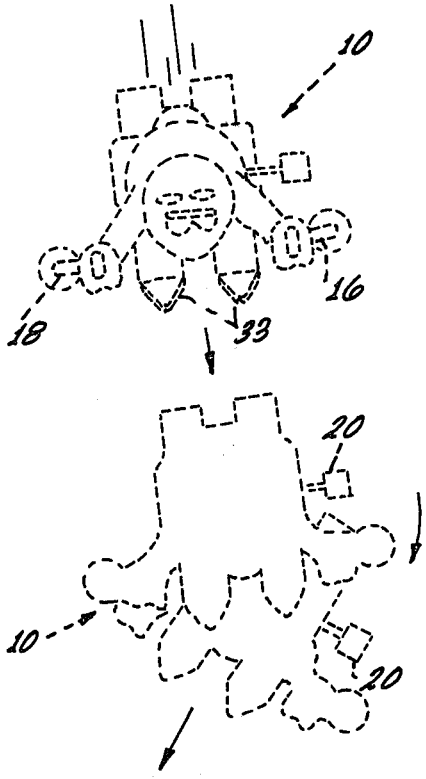
FIG. 2
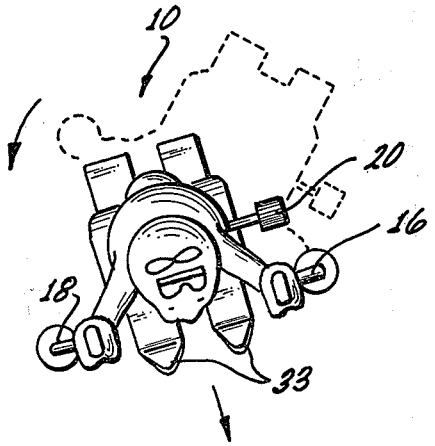

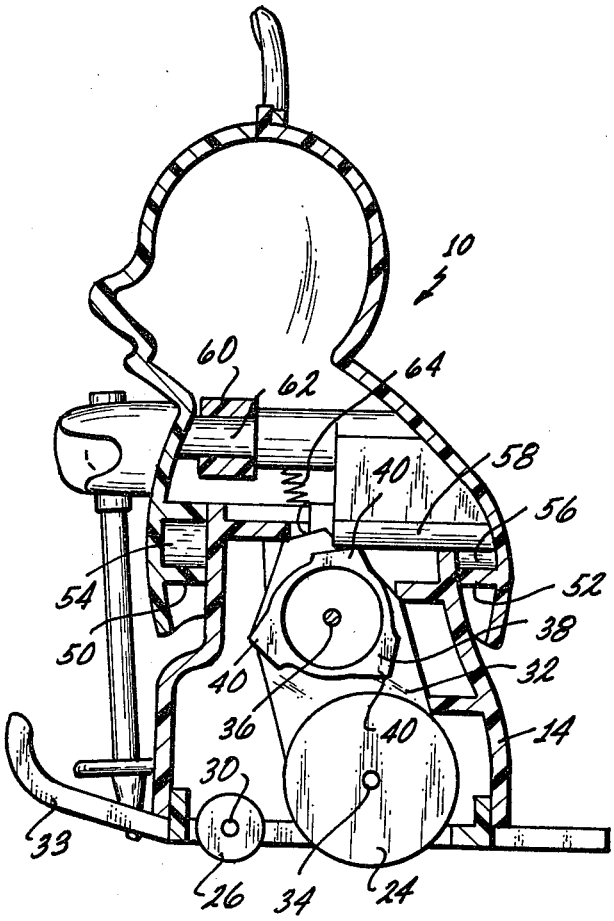
FIG. 3
FIG. 4
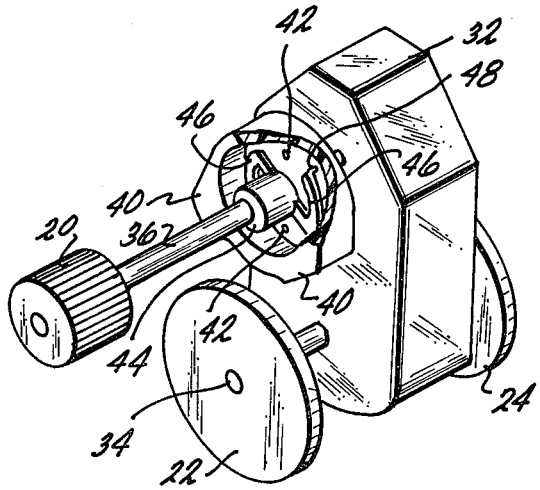

TOY CAPABLE OF PIVOTAL MOVEMENT ON A SUPPORT SURFACE

BACKGROUND OF THE INVENTION

This invention is directed to a toy having an articulated body divided into an upper and lower section. Attaching to the upper section are two extension members. The upper section is caused to rock with respect to the lower body section to alternately contact one and then the other of the extension members with the support surface. As the toy is propelled across the support surface the contact of the extension members with the support surface causes the toy to pivot about the extension members to change direction with each contact.

Certain toys are known which are capable of changing direction as they move across a support surface. One such toy is described in U.S. Pat. No. 2,649,805. This toy is essentially a tricycle like toy which will move in an oval pathway as first one and then the other of a set of wheels on a common axle is lifted upwardly from a support surface by a lever attached to the axle adjacent to the wheels which rotates with the axle. The third wheel of the triangular type arrangment is freely pivotable such that the toy will pivot about the one of the wheels located on the axle which remains in contact with the ground as the other of the wheels located on the axle is lifted free from the ground by the lever. The arrangement of the parts of this toy however, as noted earlier, cause the toy to move in an oval pathway.

Many toys are known which mimic certain real life counterpart actions. Thus, toy fire trucks are made to mimic real fire trucks, etc. One action which has not been too successfully mimicked is the action associated with snow skiing. In snow skiing, the skier moves from side to side in a very rhythmatic manner, utilizing ski poles to assist in the balance in performing these movements.

Two toys are known which mimic skiing action. The first of these, Netherlands Pat. No. 66,949, incorporates a skier which straddles a small sphere. The skier, his skis, and certain connecting elements, form a cage for the sphere with the lower part of the sphere extended out of the cage such that the totality of the toy can ride on the sphere and move as the sphere rolls in the cage. Because of the freely pivotable nature of the cage about the sphere, it is speculated that movement of this toy will depend a lot on the surface upon which the toy is moved and any objects which the toy contacts in so moving on this surface. As such, it is believed that the movement of this toy will not duplicate the free flowing movements exhibited by an actual skier.

A further skiing toy is shown in U.S. Pat. No. 2,248,214. In this toy, a figurine is mounted to an apparatus which includes two skis which are spaced apart and supported by two sets of wheels. An upward extending part of the apparatus includes a motor which is connected to a "U" shaped bracket. Two ski poles are pivotally attached to the ends of the "U" shaped bracket. The ends of the "U" shaped bracket go up and down in unison in response to the motor. In response to the ends of the bracket going up and down, the top end of the ski pole to which the bracket is attached is forced downwardly and, because of a small inclination of the ski poles from the vertical, the bottom end of the ski pole is driven into the support surface such that the totality of the toy is driven in a straightforward line across the surface by rolling on these sets of wheels.

This toy does little to mimic the free flowing movement of a skier coming down a hill making a multplicity of turns one after the other. The toy more closely mimics the movements of a skier moving across a flat surface by strict arm movement alone to propel the skier by driving the ski poles into the ground.

In view of the widespread interest in skiing, it is believed that there exists a need for a toy which is capable of mimicking the free flowing pivotal movement of a skier as the skier smoothly moves across a surface.

BRIEF DESCRIPTION OF THE INVENTION

In view of the above, it is a broad object of this invention to provide a toy which is capable of mimicking the pivotal movement of a skier as the skier moves down a hill in a smooth, free flowing manner. It is a further object of this invention to provide such a toy which is self-propelled, and thus can move under its own power across a surface to mimic the action of the skier. Additionally, it is an object of this invention to provide a toy which, because of its engineering and its manner of construction, is both enduring in use and is economical to the consuming public.

These and other objects, as will become evident from the remainder of this specification are achieved in a toy which comprises: an articulated body divided into a lower body section and an upper body section, said body having a front, left and right sides, and a back, said upper body section pivotable from side to side with respect to said lower body section about a longitudinal axis passing through said front and said back of said body; motor means located in said body; wheel means located in said lower body section and operatively connected to and driven by said motor means to propel said toy across a support surface; moving means operatively associated with said motor means and capable of pivoting said upper body section from side to side with respect to said lower body section about said longitudinal axis in response to movement imparted to said moving means by said motor means; left and right upper body extension means extending from said upper body section toward said support surface and movable in combination with said upper body section in response to pivoting of said upper body section, said left upper body extension means contacting said support surface and said right upper body extension means lifting free from said support surface as said upper body section pivots to the left side and said right upper body extension means contacting said support surface and said left upper body extension means lifting free from said support surface as said upper body section pivots to the right side; said toy pivoting about said left side upper body extension means when it contacts said surface as said wheel means propels said toy on said support surface and said toy pivoting about said right upper body extension means when it contacts said support surface as said wheel means propels said toy on said support surface.

The upper body section can be mounted to the lower body section by means of an axle and a bearing, with the axle being attached to one of the upper or lower body sections and the bearing being attached to the other. The longitudinal axis on which the upper section moves with respect to the lower section would pass through the axle means.

The wheel means preferredly would comprise at least one driving wheel extending from the bottom of the lower body section and operatively connected to the motor means and rotated by the motor means so as to propel the toy across the support surface in response to rotation of the drive wheel.

Preferredly, the moving means would comprise a cam means operatively associated with the motor means and rotated by the motor means and a cam follower means operatively associated with the upper body section and located in association with the cam means. The upper body section would be pivoted side to side with respect to the lower body section as the cam follower means moves in response to rotation of the cam means. Preferredly, the cam means would rotate in a vertical plane with at least a portion of the cam follower means contacting the cam means in moving up and down in this vertical plane in response to rotation of the cam means. Preferredly, the cam means and the cam follower means would be located toward one of the sides of the toy and a biasiag means would be included to bias the cam follower means against the cam means.

In the preferred embodiment of the toy, the biasing means would comprise a spring connecting between the upper and lower body sections to bias the cam follower means against the cam means. An auxiliary set of wheels which are free wheeling is preferredly mounted on the lower body section to help support the toy above the support surface in combination with the drive wheel. Preferredly, two drive wheels would be utilized with the drive wheels located in a space relationship from one another on the lower body section. Preferredly, the left and right upper body extension means would each contact the support means at points which are longitudinally displaced in front of the axis of rotation of both the drive wheels and the auxiliary wheels.

BRIEF DESCRIPTION OF THE DRAWINGS

This invention will be better understood when taken in conjunction with the drawings wherein:

FIG. 1 is an oblique view showing the outside motif of the illustrated embodiment of the invention;

FIG. 2 is an upper plan view of the embodiment of FIG. 1, showing in phantom lines movement of this embodiment across a support surface;

FIG. 3 is a side elevational view in partial section of the illustrated embodiment of the invention;

FIG. 4 is an oblique view in partial section of the driving mechanism of the illustrated embodiment of the invention;

Figure 5:
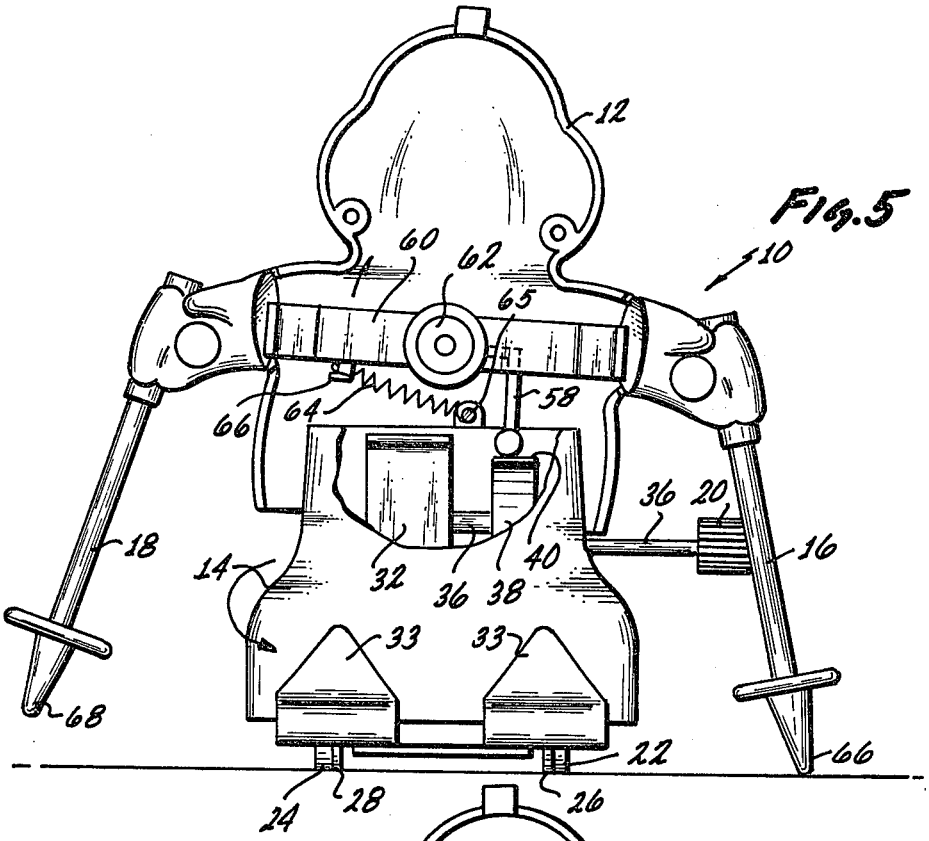
FIG. 5 is a front elevational view in partial cutaway showing one special configuration of the illustrated embodiment of the invention as the embodiment moves over a support surface.

The invention described in this specification and illustrated in the drawings utilizes certain principles and/or concepts as are set forth in the claims attached to this specification. Those skilled in the toy arts will realize that these principles and/or concepts are capable of being illustrated in a variety of illustrative embodiments. For this reason, this invention is not to be construed as being limited to the exact embodiment utilized for illustrative purposes herein, but is to be construed in light of the claims.

DETAILED DESCRIPTION OF THE INVENTION

In the Figs. the illustrative toy 10, which is a characterized figure, is shown with an upper body section 12, a lower body section 14, a left hand ski pole 16, a right hand ski pole 18 and a winding knob 20. Not seen in FIG. 1 would be a set of driving wheels 22 and 24 and a set of auxiliary wheels 26 and 28. Before describing the internal components of the toy 10, the manner in which the toy works will be described.

The toy is activated by winding the winding knob 20. After winding, the toy is set onto a support surface. The toy moves across the support surface under the influence of rotation of the driving wheels 22 and 24. As the driving wheels 22 and 24 propel the toy 10 forward across a support surface, the upper body 12 rocks from side to side about the lower body section 14. As the upper body section 12 rocks to the left, the left ski pole 16 engages the support surface. As the upper body section 12 rocks to the right, the right ski pole 18 engages the support surface. In FIG. 2, motion of the toy across a support surface for a brief interval of its movement is shown.

In the uppermost phantom Fig. of FIG. 2, the toy has been wound and has been set on a support surface and is moving thereon. In the middle phantom Fig., the toy is shown first completing a straight motion and then the right hand ski pole 18 has been engaged against the support surface to pivot the toy to the right, twisting the toy shown by the second overlapping phantom representation in the central phantom Fig. The toy then moves to the lower portion of FIG. 2 wherein both the solid line and the phantom line are shown. First the toy is in the position shown in the phantom line and as the left hand ski pole engages the support surface, the toy then pivots about this left hand ski pole and assumes the position shown in solid line. This then completes the cycle of movement of the toy such that the Fig. shown in solid in the bottom part of FIG. 2 corresponds to the uppermost phantom representation in FIG. 2. It is noted however, that the toy is slightly deviated between its position shown in the solid Fig. shown in the bottom Fig. of FIG. 2 and the uppermost phantom representation at the top of the Fig. The pivoting about the left and right hand ski poles 18 and 16, respectively, is not absolutely reproducible as to the number of degrees which the toy 10 pivots, which gives the movement of the toy 10 a more realistic life-like appearance, in that it slowly meanders over a support surface as it alternately pivots first left and then right upon the alternate engagement of the left and right hand ski poles 16 and 18, respectively.

Figure 6:
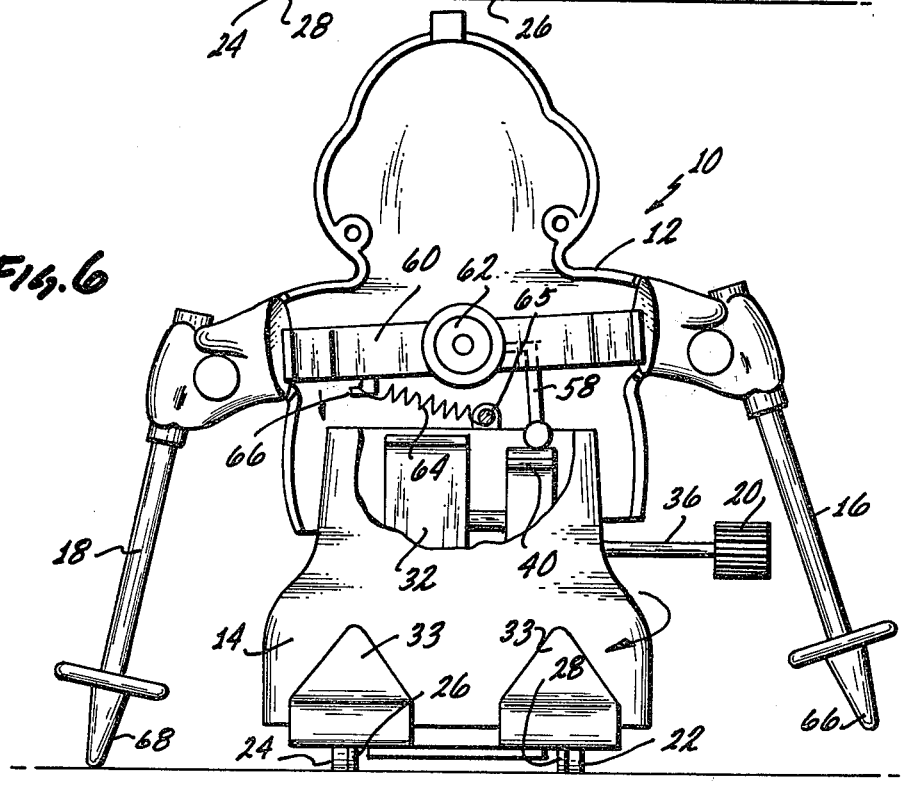
FIG. 6 is a view similar to FIG. 5 showing a different spatial configuration of the embodiment as it moves over a support surface.

In FIGS. 3, 5 and 6, it can be seen that the auxiliary wheels 26 and 28 support the toy 10 above a supporting surface. The auxiliary wheels 26 and 28 are mounted about an axle 30 in the lower portion of the lower body section 14. The auxiliary wheels 26 and 28 are freely movable on the axle 30.

Projecting out of the front and back of the toy 10 are a set of skis, collectively identified by the numeral 33. The skis 33 are completely non-functional, in that they are completely supported above the support surface by the wheels 22, 24, 26 and 28.

A motor 32 is mounted in the lower body section 14. The motor 32 includes a drive axle 34 to which the driving wheels 22 and 24 are attached. The drive axle 34 rotates in response to motion imparted to it by the motor 32. The winding knob 20 is attached to winding shaft 36 and is utilized to energize the motor 32. The motor 32 is a common spring type motor, typically found in small toys and the like. The motor 32 is appropriately located within the lower body section 14 such that the drive wheels 22 and 24 extend out of the bottom of the lower body section 14 such that they can contact a support surface and drive the toy 10 forward in response to rotation thereof.

Further supported on the winding shaft 36 is a cam 38. The cam 38 has three cam lobes collectively identified by the numeral 40. The gearing within the motor 32 is such that the drive axle 34 spins at a greater rate of rotation than the winding shaft 36 upon unwinding of the motor. As such, rotation of cam 38 is slower than the rotation of the driving wheels 22 and 24.

On the inside of the cam 38 are located a plurality of holes collectively identified by the numeral 42. The cam 38 itself is not fixedly attached to the winding shaft 36, but is free to rotate thereon. A collar 44 is attached to the winding shaft 36 and rotates in response to rotation of the winding shaft. Extending outwardly from the collar 44 are two spiral arms collectively identified by the numeral 46. Each of these spiral arms 46 includes a small projection 48 located on each end. The projections 48 fit into two of the holes 42 and thus are capable of transferring motion of the winding shaft 36 via the collar 44 and the arms 46 to the cam 38. The arms 46 however, are spring arms and are capable of moving away from the cam 38 such that the projections 48 can be lifted free from the holes 42. Thus, if, for some reason, the cam 38 is fixedly held against rotation, as will be evident below, should the upper body section 12 be fixedly held with respect to the lower body section 14, rotation of the winding knob 20 and the winding shaft 36 will result in the arms 46 flexing to withdraw the projections 48 from the holes 42, thus allowing for winding of the motor 32 without rotating the cam 38, should the cam 38 be held fast. The interaction of the arms 46 and the projections 48 located thereon with the holes 42 in the cam 38 thus serves as a clutch mechanism.

The upper body section 12 includes a front bearing 50 and a rear bearing 52. A front axle 54 and a rear axle 56 which are coaxial with each other about a longitudinal line passing through each other, are formed as part of the lower body section 14. The front and rear bearings 50 and 52 are further formed as an integral part of the upper body section 12. The upper body section 12 rotates upon the lower body section 14 by rotation of the bearings 50 and 52 about the axles 54 and 56.

A cam follower 58 is integrally formed as part of the upper body section 12. The cam follower 58 contacts the cam 38 and, as the cam 38 rotates, the individual cam lobes 40 strike the cam follower 58, raising the cam follower 58, which causes rotation of the upper body section 12 about its pivot point centered in the longitudinal axis passing through the axles 54 and 56. As the cam follower 58 descends off of the individual lobes 40 of the cam 38, the upper body section 12 is then free to rock to the other side.

A cross member 60 is fixedly mounted about a boss 62 which is integrally formed as a part of the upper body section 12. The cross member 60 projects out of the upper body section 12 and has the left and right ski poles attached to its respective ends. Thus, as the upper body section 12 rocks from side to side with respect to the lower body section 14, the left and right ski poles 16 and 18 are lifted from or pushed down to contact a support surface.

A spring 64 extends between a projection 66 located on the cross member 60 and a small axle 65 located on the lower body section 14. The spring 64 biases the upper body section 12 such that it rocks toward the right as is seen in FIG. 5. The upper body section 12 however, can only rock to the right when the cam follower 58 is not located on top of one of the cam lobes 40. When the cam lobes 40 engage the cam follower 58 it rocks the upper body section 12 toward the left, as is seen in FIG. 6, against the bias of spring 64. This stretches the spring 64 slightly such that when the cam lobe 40 is moved out of engagement with the cam follower 58 the spring 64 then once again rocks the upper body section 12 to the right.

On movement of the upper body section 12 to the left and right about the longitudinal axis which passes through the center of the axles 54 and 56, the tips 66 and 68 of the respective ski poles 16 and 18 contact the support surface on which the toy 10 rests. The contact between the tips 66 and 68 is not sufficient to lift one side or the other of the toy 10 upwardly from the support surface, but is simply enough to frictionally engage the tips 66 or 68 against the support surface such that further forward momentum of the toy 10 under the rotation of the drive wheels 22 and 24 causes rotation of the toy 10 about the particular ski tip 66 or 68 which happens to be in contact with the support surface. The opposite ski pole 16 or 18, which does not have its tip 66 or 68 in contact with the support surface is moved such that its tip 66 or 68 is lifted free from the support surface and there is no frictional engagement between the support surface and this respective tip 66 or 68. By alternately contacting the tips 66 or 68 with the support surface, the toy 10 alternately pivots to the left and to the right as it moves in a generally forward direction under the influence of the drive wheels 22 and 24.

The cam 38 and the cam follower 58 are located toward the left side of center of the toy 10. The contact of the spring 64 with the cross member 68 is at a point on the other side of center of the toy 10. As such, movement of the cam follower 58 up and down in response to the rotation of the cam 38 in a vertical plane causes the side to side pivoting of the upper body 12 on the lower body 14.

We claim:

1. A toy which comprises:

an articulated body divided into a lower body section and an upper body section, said body having a front, left and right sides, and a back, said upper body section pivotable from side to side with respect to said lower body section about a longitudinal axis passing through said front and said back of said body;

motor means located in said body;

wheel means located in said lower body section and operatively connected to and driven by said motor means to propel said toy across a support surface;

moving means operatively associated with said motor means and capable of pivoting said upper body section from side to side with respect to said lower body section about said longitudinal axis in response to movement imparted to said moving means by said motor means;

left and right upper body extension means extending from said upper body section toward said support surface and movable in combination with said upper body section in response to pivoting of said upper body section, said left upper body extension means contacting said support surface and said right upper body extension means lifting free from said support surface as said upper body section pivots to the left side and said right upper body extension means contacting said support surface and said left upper body extension means lifting free from said support surface as said upper body section pivots to the right side;

said toy pivoting about said left side upper body extension means when it contacts said surface as said wheel means propels said toy on said support surface and said toy pivoting about said right upper body extension means when it contacts said support surface as said wheel means propels said toy on said support surface.

2. The toy of claim 1 wherein:

one of said upper body section or said lower body section includes an axle means and the other of said upper body section or said lower body section includes a bearing means, said axle means rotatably located in said bearing means, said longitudinal axis passing through said axle means, said upper body section moving from side to side with respect to said lower body section by rotation of said axle means in said bearing means.

3. The toy of claim 2 wherein:

said wheel means comprises at least one driving wheel extending from the bottom of said lower body section, said driving wheel operatively connected to said motor means and rotated by said motor means to propel said toy across said support surface.

4. The toy of claim 3 wherein:

said moving means comprises a cam means operatively associated with said motor means and rotated by said motor means and a cam follower means operatively associated with said upper body section and located in association with said cam means, said upper body section pivoting from side to side with respect to said lower body section as said cam follower means moves in response to rotation of said cam means.

5. The toy of claim 4 wherein:

said cam means rotates in a vertical plane and at least a portion of said cam follower means contacts said cam means and moves up and down in said vertical plane in response to rotation of said cam means.

6. The toy of claim 5 including:

said cam means and said cam follower means located toward one of said right or said left sides of said toy and said moving means further includes biasing means biasing said cam follower means against said cam means.

7. The toy of claim 6 wherein:

said biasing means comprises a spring connecting between said upper body section and said lower body section and biasing said cam follower means against said cam means.

8. The toy of claim 7 further including:

a set of auxiliary wheels freely rotatably mounted to said lower body section, said toy supported above said support surface by the combination of said drive wheel and said auxiliary set of wheels.

9. The toy of claim 8 including:

a set of drive wheels spaced apart from one another on said lower body section.

10. The toy of claim 9 wherein:

said left and said right upper body extension means contact said support surface at respective points which are longitudinally displaced in front of the axis of rotation of both said drive wheels and said auxiliary wheels.

* * * * *